US006339844B1

(12) United States Patent
Merkley

(10) Patent No.: US 6,339,844 B1
(45) Date of Patent: Jan. 22, 2002

(54) PEAKED CAP

(76) Inventor: Murray Roy Merkley, 134 Inglewood Dr., Toronto, Ontario (CA)

( * ) Notice: Subject to any disclaimer, the term of this patent is extended or adjusted under 35 U.S.C. 154(b) by 0 days.

(21) Appl. No.: 09/795,138

(22) Filed: Mar. 1, 2001

(51) Int. Cl.[7] ..... A42B 1/00
(52) U.S. Cl. ..... 2/195.3; 2/195.1; 2/181.2
(58) Field of Search ..... 2/181, 181.2, 175.1, 2/195.1, 195.2, 195.3, 209.12

(56) References Cited

U.S. PATENT DOCUMENTS 5,432,955 A * 7/1995 Plotka et al. ..... 2/181
5,915,534 A * 7/1999 May ..... 2/181.4
5,920,910 A * 7/1999 Calvo ..... 2/181.4
5,966,742 A * 10/1999 Cunliffe ..... 2/195.3
5,983,398 A * 11/1999 Kronenberger ..... 2/181

* cited by examiner

*Primary Examiner*—Bibhu Mohanty

(57) ABSTRACT

A baseball type hat includes a main body portion formed by a plurality of pie shaped panels secured to one another and a front bill secured to the main body portion of the hat. The main body portion of the hat has a lower edge provided with a head band. The head band is formed from a plurality of head band sections including fixed length elastic side sections of the head band. The side sections, which comprise about half the length of the band, provide for automatic head size adjustment and maintain their elasticity with repeated use of the hat.

6 Claims, 1 Drawing Sheet

PEAKED CAP

FIELD OF THE INVENTION

The present invention relates to a baseball type hat having a head band with elasticized band sections which automatically adjust to different head sizes.

BACKGROUND OF THE INVENTION

A traditional baseball type hat has a small adjustment band at the back of the hat to fit to different head sizes.

Recently a hat as described in U.S. Pat. No. 5,715,540 has been made available to the public. This hat has a head band made from a single piece of elasticized material which extends fully around the hat and which provides substantially greater adjustment than more traditional hats. However, at the same time, this patented hat suffers from a number of drawbacks. For instance, the elastic material of the head band is not comfortable across the forehead of the user after extended periods of time. In addition, a single piece of elastic, long enough to encircle the head of the user, is unable to maintain sufficient elasticity, particularly after many uses, to perform its desired adjustability function.

SUMMARY OF THE INVENTION

The present invention relates to a baseball type hat having the adjustment benefits without suffering from the noted drawbacks of the above-mentioned patented hat.

More particularly, the baseball type hat of the present invention comprises a main body portion and a front bill secured to the main body portion of the hat.

The main body portion has a lower edge provided with a band made up of a plurality of band sections. These sections include front and back fixed length sections separating elastic sections of the band. The elastic band sections, which take up about half the length of the band, provide for head size adjustment while the fixed length band sections control the length of the elastic sections to the point that they are not overly long and do not quickly lose their elasticity.

According to an aspect of the invention, the front fixed length section is made from a comfort fit, sweat absorbing material, adding further to the beneficial features of the hat.

BRIEF DESCRIPTION OF THE DRAWINGS

The above and other benefits and features of the invention will be described in greater detail according to the preferred embodiments of the invention in which.

DETAILED DESCRIPTION ACCORDING TO THE PREFERRED EMBODIMENTS OF THE PRESENT INVENTION

Figure 1:
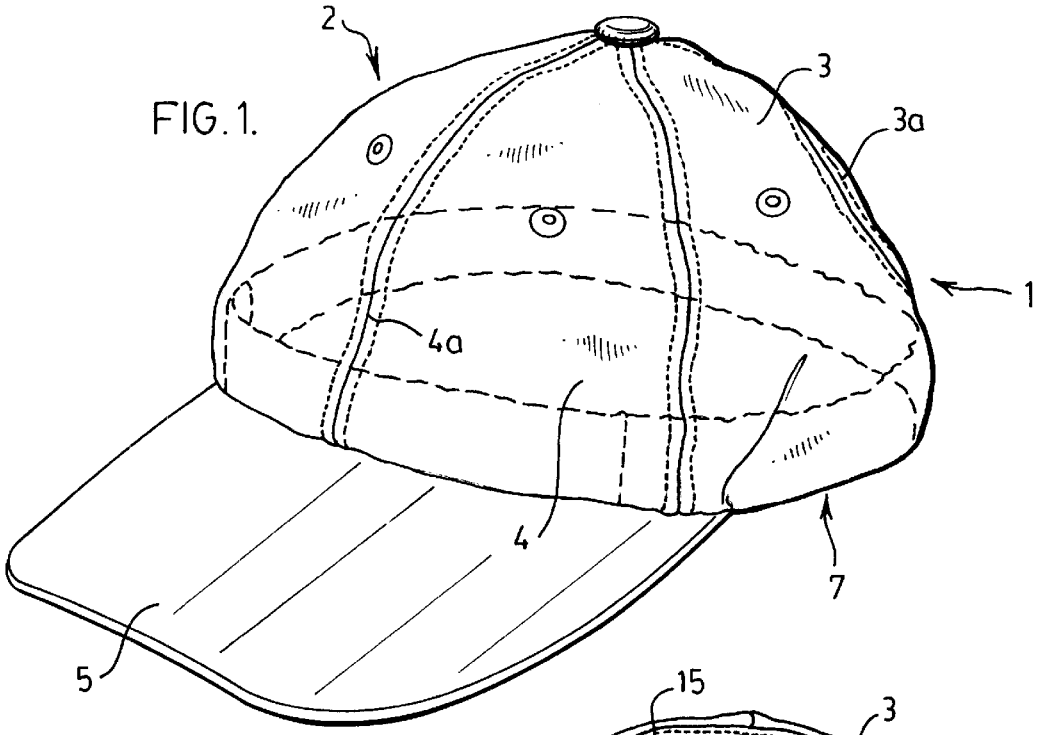
FIG. 1 is a top perspective view of the hat made in accordance with a preferred embodiment of the invention.
Figure 2:
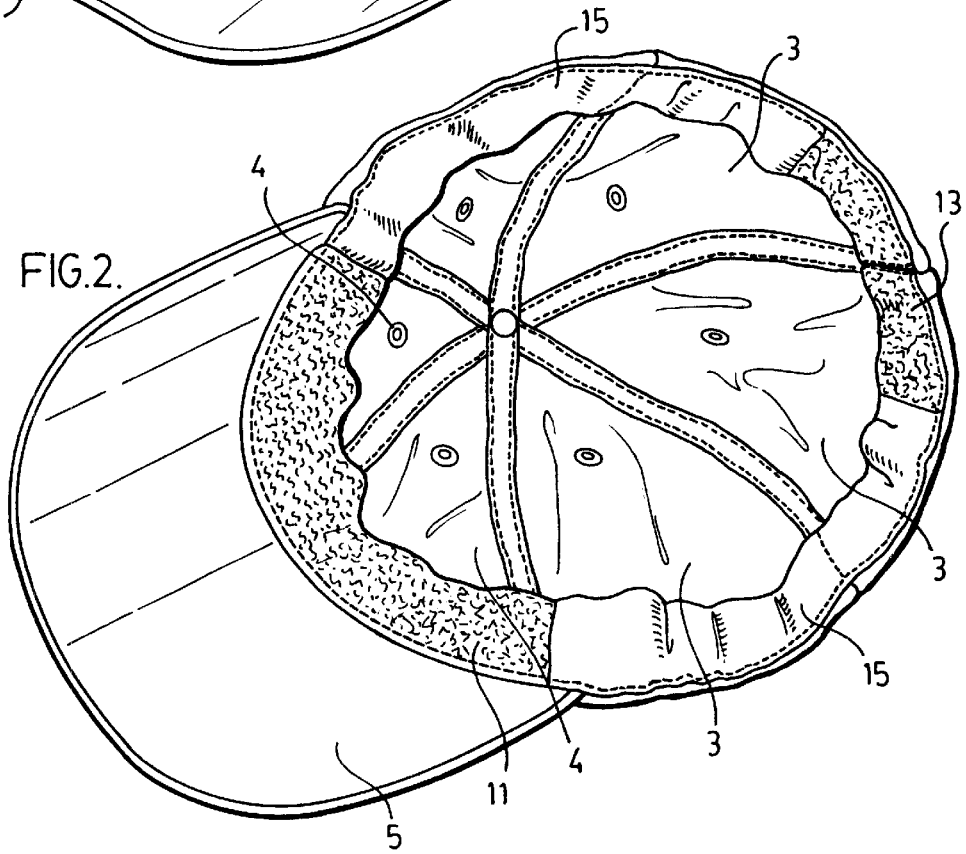
FIG. 2 is a bottom view of the hat of FIG. 1.

FIG. 1 shows a baseball type hat generally indicated at 1. This hat is formed by a main body portion 2 with a bill 5 attached to the front of the main body portion of the hat.

Body portion 2 is formed from a plurality of preshaped panels 3 and 4. These panels are secured to one another at regions 3*a* and 4*a* of the hat.

Provided along the lower edge of the main body portion of the hat is a head band 7. This head band is formed from a plurality of band sections comprising a front section 11, a rear section 13 and side sections 15. Note that the side sections are separated from one another by the front and back sections of the band.

The side sections 15 which occupy about half the length of the band, are made from elastic or stretch material. The front and back band sections are made from fixed length or non-stretch material.

Preferably the front band section 11 is made from a comfort fitting, sweat absorbing material, which when the hat is worn with the bill forward, lies on the forehead of the user.

The back section of the band can also be made from the same material used in the front section. Therefore, the hat can be worn backwards, which is a big trend, with sweat band material again lying comfortably against the forehead of the user.

The side band sections provide for automatic size adjustment of the hat. They will stretch out from their normally retracted state to fit any one of numerous different head sizes. Furthermore, because the elastic band sections do not extend the complete length of the band, they are not overly long but rather are of a length to maintain their elasticity with repeated use of the hat.

In terms of proportions, the full length of the band is in the order of about 20 to 22 inches with each side section being about 5 inches unstretched length. Accordingly the length of the two side sections combined is about half the overall length of the band.

The main body portion of the hat must be adapted to accommodate the stretching of the head band. This can be done in one of several different ways.

For example, the main body portion can be made large enough to allow full stretching of the head band. In this case, the main body portion will collapse to something below its full size as the head band retracts to less that its fully extended length.

In another example, as shown in the drawings, the more rearward panels 3 of the main body portion of the hat are also made from stretch material which expand and contract with the head band. The more forward panels 4 do not need to be made from stretch material inasmuch as the head band does not stretch in this region of the hat.

Rather than making the panels from stretch material, the securing regions 3*a* between panels 3 can be made from stretch material to enable the main body portion of the hat to expand and contract with the head band.

It will now be understood from the description above how the hat of the present invention has both automatic size adjustment as well as comfort features and, although various preferred embodiments have been described in detail, it is to be appreciate that variations may be made without departing from the scope of the invention.

The embodiments of the invention in which an exclusive property or privilege is claimed are defined as follows:

1. A baseball type hat comprising a main body portion formed by a plurality of pie shaped panels secured to one another and a front bill secured to said main body portion, said main body portion having a lower edge provided with a head band, said head band comprising a plurality of band sections including fixed length front and back sections and elastic side sections, said side sections comprising about half the length of said band.

2. A baseball type hat as claimed in claim 1 wherein said front section of said band is made from a sweat absorbing comfort fit material.

3. A hat as claimed in claim 1, wherein said panels include front panels to which said bill is attached and rear panels away from said bill, said rear panels being made of elastic material.

4. A hat as claimed in claim 2 wherein said front panels are made of a fixed sized material.

5. A hat as claimed in claim 2 wherein said front band section extends along said lower edge of said body portion across said front panels.

6. A hat as claimed in claim 1 wherein said panels are secured to one another by elastic material.

* * * * *